US006513957B2

(12) United States Patent
Huang

(10) Patent No.: US 6,513,957 B2
(45) Date of Patent: Feb. 4, 2003

(54) SELF-SUPPORTED LAMP STRUCTURE

(76) Inventor: Ming-Hsien Huang, No. 2, Lane 65, Cheng Kon Road, Hsinchu (TW)

( * ) Notice: Subject to any disclaimer, the term of this patent is extended or adjusted under 35 U.S.C. 154(b) by 0 days.

(21) Appl. No.: 09/887,355

(22) Filed: Jun. 25, 2001

(65) Prior Publication Data

US 2002/0196633 A1 Dec. 26, 2002

(51) Int. Cl.[7] ..... F21V 13/10
(52) U.S. Cl. ..... 362/431; 362/391; 362/414
(58) Field of Search ..... 362/806, 431, 362/391, 410, 414

(56) References Cited

U.S. PATENT DOCUMENTS 5,062,028 A * 10/1991 Frost et al. ..... 362/183
5,398,180 A * 3/1995 Lee ..... 362/431
5,526,243 A * 6/1996 Masters ..... 362/122
6,010,232 A * 1/2000 Chen ..... 362/414
6,135,623 A * 10/2000 Lin ..... 362/431
6,358,457 B1 * 12/2001 Huang ..... 362/353

FOREIGN PATENT DOCUMENTS

CA 613648 * 1/1961 ..... 362/431

* cited by examiner

*Primary Examiner*—Thomas M. Sember
(74) *Attorney, Agent, or Firm*—Rosenberg, Klein & Lee

(57) ABSTRACT

This invention relates to a multi-used patterned lamp, which includes a connector with an inner cap. A tube with a patterned lamp is capable of being connected with the connector easily. The connector can connect with a rod, which is inserted into the ground to obtain a standing decorative patterned lamp. The connector can also be hanged by a rope or the electrical wire to become a hanging decorative patterned lamp.

3 Claims, 4 Drawing Sheets

SELF-SUPPORTED LAMP STRUCTURE

BACKGROUND OF THE INVENTION

Patterned lamps used to display special decorative effects having various designs are well-known. There is a kind of patterned lamp, which uses a rod to connect with the lamp at a top end and to insert its lower end into the ground. There is another kind of patterned lamp, which can be hung by the electrical wire of the bulb assembly to obtain a different decorative style. The known patterned lamp has its own structure for the single display and is not changeable.

Accordingly, the primary object of the invention is to provide a multi-use lamp support structure, which can be displayed in a hanging state by the wire as well as in a standing state by use of a rod. Now the features and advantages of the invention will be described in detail with reference to the accompanying Drawings.

BRIEF DESCRIPTION OF THE INVENTION

DETAILED DESCRIPTION OF THE INVENTION

Figure 1:
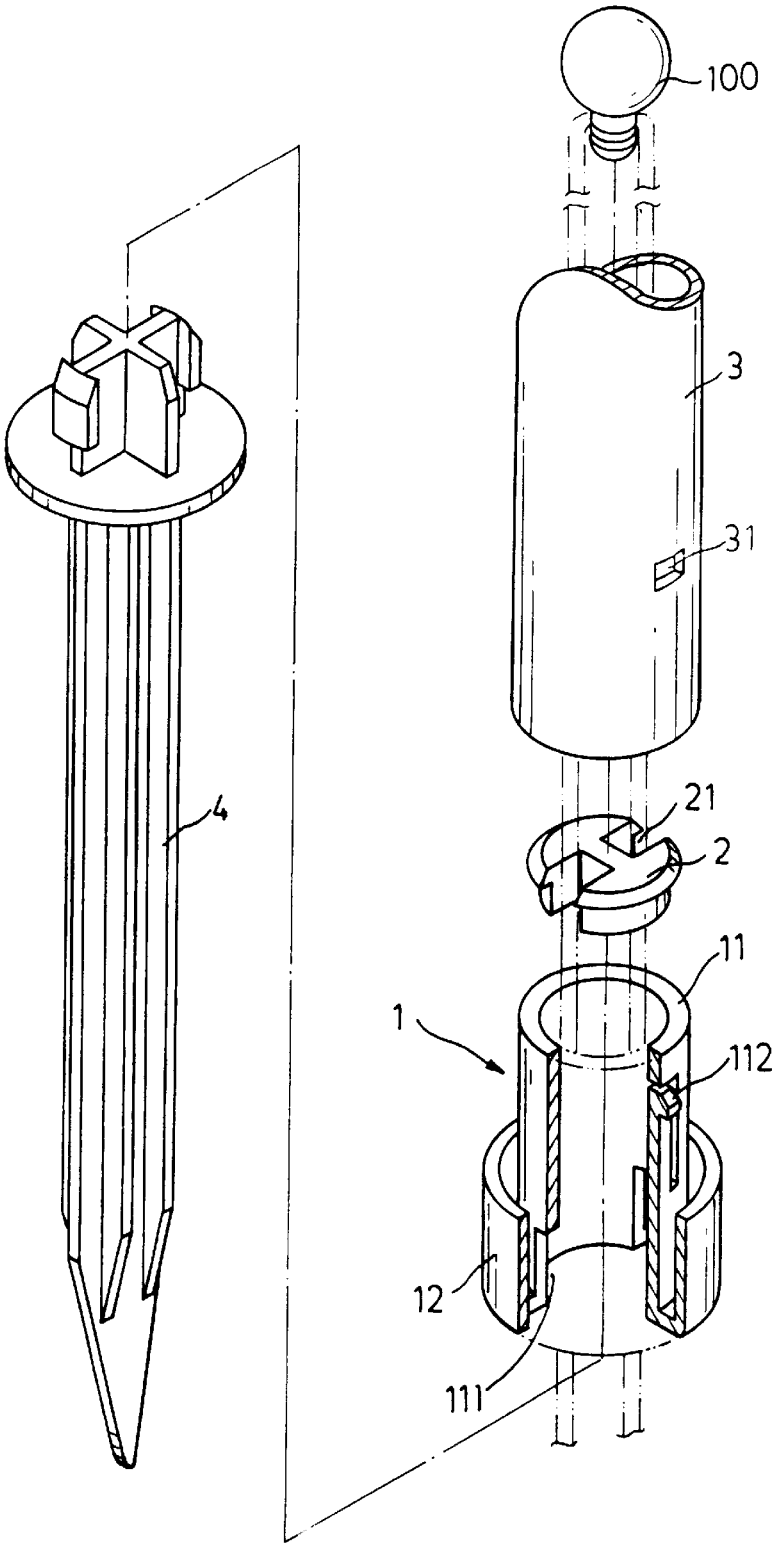
FIG. 1 is an exploded perspective view showing a lamp used in a standing state according to the present invention.
Figure 3:
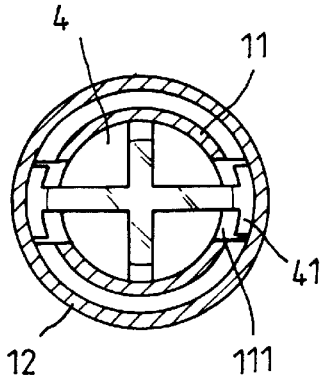
FIG. 3 is a cross-sectional plan view along line 3—3 of FIG. 2.
Figure 2:
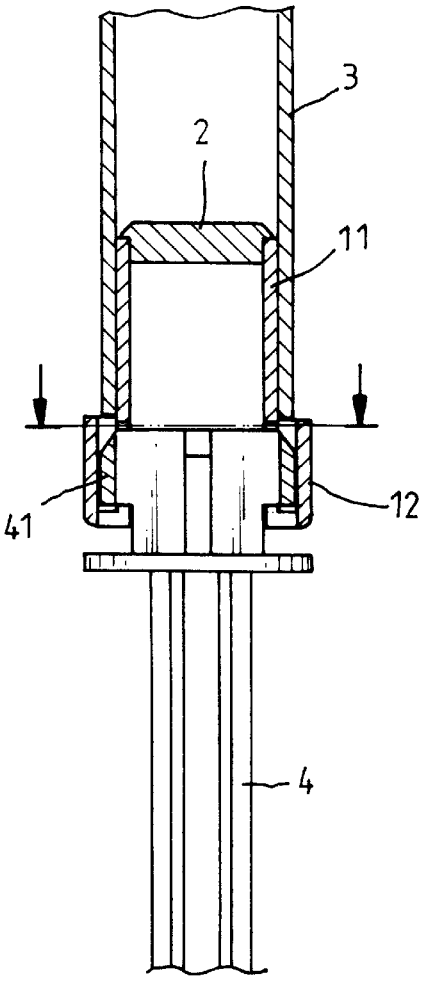
FIG. 2 is an assembled cross-sectional plan view of FIG. 1 according to the present invention.

FIGS. 1 and 2 show a standing lamp according to the present invention, which includes a connector (1) having an inner sleeve (11) and an end folded outer sleeve (12). As shown in FIG. 3, two engaging grooves (111) are formed on opposite sides of the inner sleeve (11), which is positioned inside the outer sleeve (12). A longitudinal hook (112) is provided at a side of the inner sleeve (11). A cap (2), having two separated openings (21), is placed at the top end of the connector (1). A tube (3) having a side groove (31) can connect with the connector (1), and when the hook (112) engages with side groove (31), the connector (1) and the tube (3) are firmly connected and engaged. The lamp (100) is received by the opposite end of the tube (3).

Figure 4:
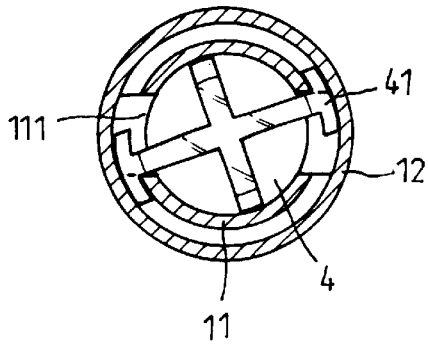
FIG. 4 is a plan view of FIG. 3 after rotation through an angle for engagement.
Figure 5:
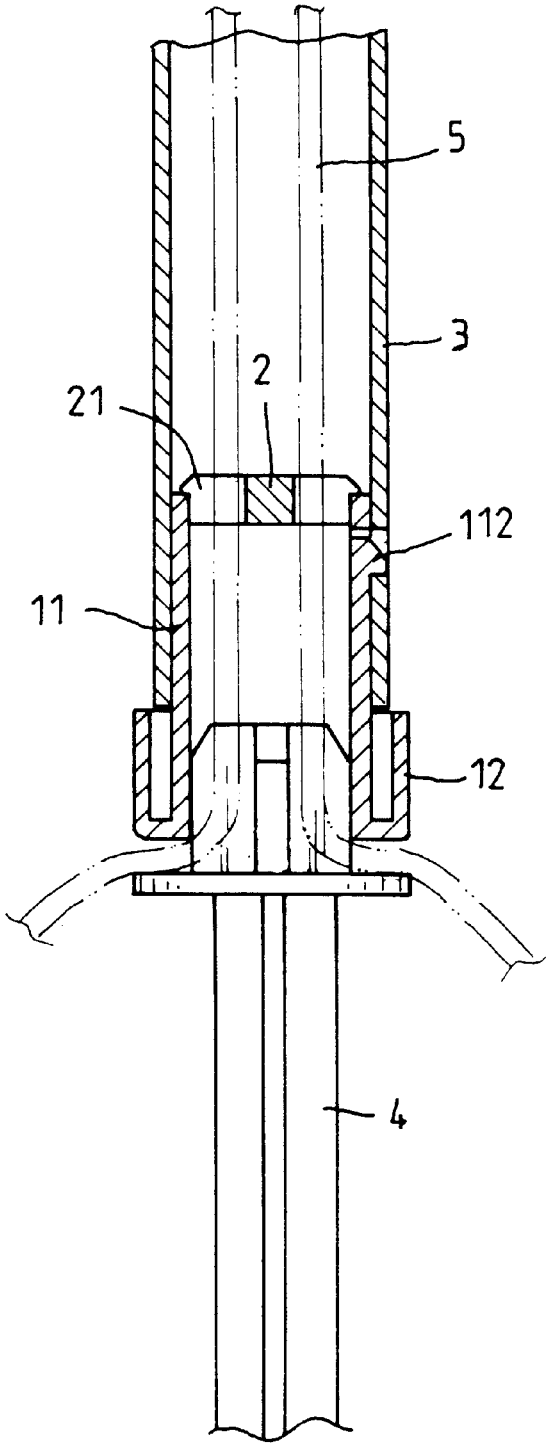
FIG. 5 is a side plan view of FIG. 2 showing connection with the electrical wire.

A rod (4) has two arched portions (41) at the top end to insert into connector (1), the arched portions (41) engaging the engaging grooves (111) of the inner sleeve (11), as shown in FIGS. 3 and 4. Rod (4) can be rotated a small angle to obtain a secure connection between rod (4) and connector (1), with tube (3) and the lamp (100) forming a complete body. The lower end of rod (4) is inserted into the ground and electrical wires (5) are extended downward from separated opening (21) to an electrical source or another lamp, as shown in FIG. 5, to create a standing lamp.

Figure 6:
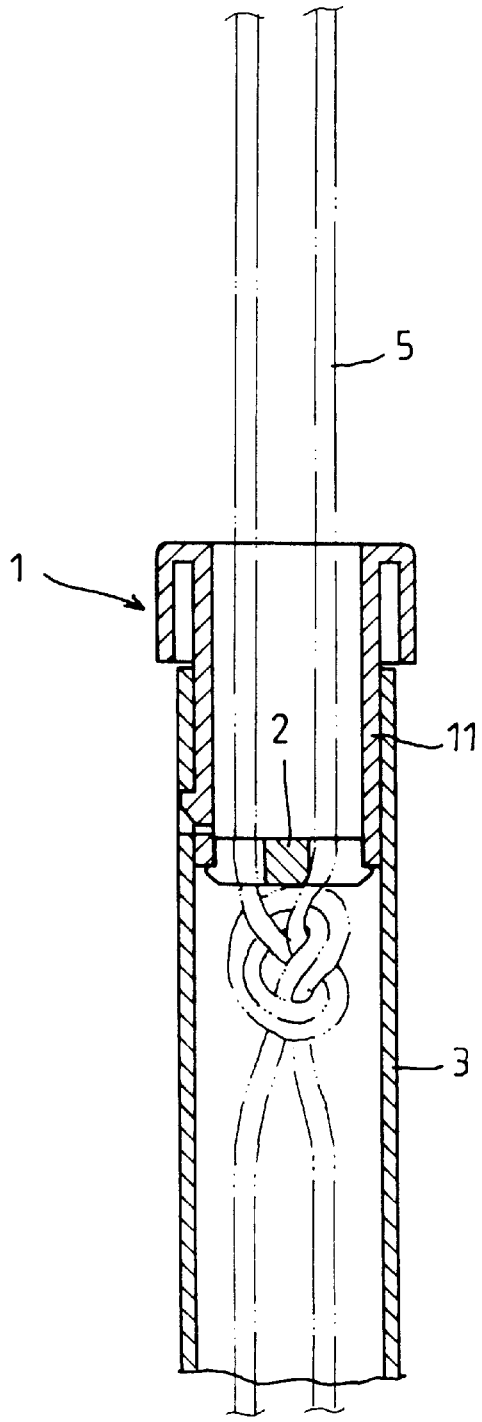
FIG. 6 is a cross-sectional plan view showing a lamp used in a hanging state according to the present invention.

Referring to FIG. 6, there is shown a hanging lamp according to the present invention. In hanging display, the connector (1) is turned upside-down without rod (4). A separate rope or electrical wire (5) is used as support and is passed through the opening (21) of the cap (2) and is wound together, as shown. The connector (1) is then hung, thus creating another hanging configuration for the lamp.

Accordingly, the present invention provides a new assembled structure, which can provide a multi-use lamp support which may stand on its own or be hung, for decorative purposes.

Although the invention has been described in connection with specific forms and embodiments thereof, it will be appreciated that various modifications other than those discussed above may be resorted to without departing from the spirit or scope of the invention, as defined in the appended claims.

What is claimed is:

1. A self-supported lamp structure, comprising:

a rod member having a pair of engaging projections formed on an upper end thereof;

an outer sleeve member;

an inner sleeve member positioned within said outer sleeve member, said inner sleeve member having a pair of engaging grooves formed therein, said engaging grooves releasably receiving said pair of engaging projections of said rod member, said engaging projections being releasably locked within an inner region formed between said inner and outer sleeve members upon rotation of said rod member with respect to said inner sleeve member, said inner sleeve member having a hook member formed thereon;

a tubular member releasably mounted on said inner sleeve member, a lower end of said tubular member having an opening formed therethrough, said opening releasably receiving and engaging said hook member of said inner sleeve member; and, a lamp mounted on an upper end of said tubular member.

2. The self-supported lamp structure as recited in claim 1 wherein a cap member is releasably mounted on an upper end of said inner sleeve member.

3. The self-supported lamp structure as recited in claim 1 wherein said self-supported lamp structure is adapted to be hung from a supporting surface.

* * * * *